United States Patent [19]

Wenman

[11] Patent Number: 4,754,377

[45] Date of Patent: Jun. 28, 1988

[54] THERMALLY PROTECTED RECESSED LIGHTING FIXTURE

[75] Inventor: James A. Wenman, Louisville, Ky.

[73] Assignee: Thomas Industries, Inc., Louisville, Ky.

[21] Appl. No.: 832,458

[22] Filed: Feb. 21, 1986

[51] Int. Cl.[4] ..... F21S 1/02

[52] U.S. Cl. ..... 362/148; 362/294; 362/373; 362/364

[58] Field of Search ..... 362/294, 295, 364, 373, 362/147, 148, 150, 276, 802, 365, 368

[56] References Cited

U.S. PATENT DOCUMENTS

| | | | |
|---|---|---|---|
| 2,297,124 | 9/1942 | Anderson et al. . | |
| 2,465,248 | 3/1949 | McCandless . | |
| 2,556,690 | 6/1951 | Guth . | |
| 2,716,185 | 8/1955 | Burliuk et al. . | |
| 2,741,695 | 4/1956 | Schockett . | |
| 2,859,333 | 11/1958 | Burliuk et al. . | |
| 2,922,030 | 1/1960 | Bobrick . | |
| 3,040,172 | 6/1962 | Chan . | |
| 3,104,833 | 9/1963 | Stuart et al. . | |
| 3,130,949 | 4/1964 | Erhardt et al. . | |
| 3,158,329 | 11/1964 | Wince . | |
| 3,268,721 | 8/1966 | Dworkin et al. . | |
| 3,286,090 | 11/1966 | Prown . | |
| 3,291,979 | 12/1966 | Logan . | |
| 3,300,634 | 1/1967 | Liberman . | |
| 3,310,672 | 3/1967 | Bursell . | |
| 3,313,931 | 4/1967 | Klugman . | |
| 3,316,399 | 4/1967 | Totten . | |
| 3,370,165 | 2/1968 | Chan . | |
| 3,375,368 | 3/1968 | Dorsky | 362/294 |
| 3,518,420 | 6/1970 | Kripp . | |
| 3,609,346 | 9/1971 | Lund et al. . | |
| 3,660,651 | 5/1972 | Miles, Jr. . | |
| 3,683,173 | 8/1972 | Guth, Jr. et al. . | |
| 3,697,742 | 10/1972 | Bobrick . | |
| 3,721,817 | 3/1973 | Contratto . | |
| 3,778,609 | 12/1973 | Liberman . | |
| 3,801,815 | 4/1974 | Docimo . | |
| 3,852,583 | 12/1974 | Puyplat . | |
| 3,878,505 | 4/1975 | Seibert . | |
| 3,895,227 | 7/1975 | Murray et al. . | |
| 4,039,822 | 8/1977 | Chan et al. . | |
| 4,048,491 | 9/1977 | Wessman . | |
| 4,054,790 | 10/1977 | Slaughter . | |
| 4,081,667 | 3/1978 | Lewin et al. . | |
| 4,104,713 | 8/1978 | Chan et al. | 362/294 |
| 4,163,276 | 7/1979 | Tabatchnik-Michaell . | |
| 4,181,930 | 1/1980 | Mewissen et al. . | |
| 4,186,433 | 1/1980 | Baldwin . | |
| 4,197,574 | 4/1980 | Weiss . | |
| 4,232,361 | 11/1980 | Kelsall . | |
| 4,238,815 | 12/1980 | Price . | |
| 4,254,455 | 3/1981 | Neal, Jr. . | |
| 4,274,615 | 6/1981 | Chan et al. . | |
| 4,293,895 | 10/1981 | Kristofek . | |
| 4,302,798 | 11/1981 | Hoffman Sit . | |
| 4,302,801 | 11/1981 | Duddy . | |
| 4,306,279 | 12/1981 | Cohen . | |
| 4,313,154 | 1/1982 | Capostagno et al. . | |
| 4,321,659 | 3/1982 | Wheeler . | |
| 4,327,403 | 4/1982 | Capostagno et al. . | |
| 4,336,575 | 6/1982 | Gilman . | |
| 4,358,635 | 11/1982 | Druffel . | |
| 4,388,677 | 6/1983 | Druffel . | |
| 4,399,497 | 8/1983 | Druffel . | |
| 4,400,766 | 8/1983 | Munson . | |
| 4,403,277 | 9/1983 | Eargle, Jr. et al. . | |
| 4,420,802 | 12/1983 | Smester et al. . | |
| 4,423,471 | 12/1983 | Gordin et al. . | |
| 4,437,142 | 3/1984 | Donato et al. | 362/226 |
| 4,450,512 | 5/1984 | Kristofek | 362/294 |
| 4,453,203 | 6/1984 | Pate . | |
| 4,459,648 | 7/1984 | Ullman . | |
| 4,460,944 | 7/1984 | Gordbegli et al. | 362/373 |

*Primary Examiner*—Ira S. Lazarus

*Assistant Examiner*—D. M. Cox

*Attorney, Agent, or Firm*—Hill, Van Santen, Steadman & Simpson

[57] ABSTRACT

A thermally protected recessed lighting fixture includes a generally cylindrical housing divided by a partition into a closed upper chamber and an open-bottom lower chamber. A reflector assembly including a reflector and lamp socket is removably mountable in the lower chamber. The reflector assembly carries a thermally insulating and flame-resistant shroud which encloses its rear side and is generally conical in shape. In use, the shroud is spaced from the walls of the lower chamber to form a heat sink space therein. Conductors from the lamp socket extend through a slit in the shroud to a plug which is matable with a receptacle in the partition, the receptacle being connected to associated circuitry in the upper chamber.

17 Claims, 3 Drawing Sheets

THERMALLY PROTECTED RECESSED LIGHTING FIXTURE

BACKGROUND OF THE INVENTION

The present invention relates to lighting fixtures, and particularly fixtures of the type which utilize an incandescent lamp and are recessed in the ceiling of a room.

Lighting fixtures of this type commonly encounter the problem of excessive heat buildup. While such light fixtures typically include a reflector for directing the majority of the infrared and visible light rays downwardly into the room, nevertheless a considerable amount of heat is transferred upwardly into the recess in which the fixture is mounted. This can subject the wiring of the light fixture to overheating, possibly causing failure of the wiring insulation and resulting in a risk of short circuits and fire. Furthermore, the space above a room ceiling is often filled with thermal insulation to prevent heat loss from the room through the ceiling. Such insulation is frequently formed of flammable material and, therefore, must be kept well away from the recessed lighting fixture to avoid any chance of fire. This clearance space impairs the effectiveness of the insulation.

To avoid the danger of overheating, it has been necessary in many applications that prior recessed lighting fixture arrangements be limited to use with incandescent lamps of no greater than a predetermined maximum wattage, such as 40 watts output so as to minimize the generated heat to an amount insufficient to produce excessive heat buildup. This, of course, also limits the light output.

Another alternative is to provide heat-sensitive switches which automatically disconnect the lamp if the temperature in the fixture rises to a dangerous level. But this can result in annoying and inconvenient interruptions of the light source.

SUMMARY OF THE INVENTION

It is a general object of the invention to provide an improved recessed lighting fixture which avoids the disadvantages of prior constructions while affording additional structural and operating advantages.

An important object of the invention is the provision of a recessed lighting fixture which inhibits heat transfer from the lamp to the fixture housing and to the ceiling recess in which the fixture is mounted.

Another object of the invention is the provision of a lighting fixture of the type set forth which permits the use of larger wattage lamps without excessive heat buildup.

It is another object of the invention to provide a lighting fixture of the type set forth which affords thermal insulation of the lamp and its associated reflector.

Yet another object of the invention is the provision of a lighting fixture of the type set forth which provides thermally insulating air spaces in the fixture housing.

These and other objects of the invention are attained by providing in a recessed lighting fixture including a housing having an open bottom and a closed top, and a reflector assembly having rear side and a reflective front side and adapted for receiving an associated lamp, wherein the reflector assembly is mountable in the housing in a use position with the rear side facing the inside of the housing and with the reflective front side disposed for cooperation with the lamp to direct a beam of light through the open bottom of the housing, the improvement comprising: a thermally insulating shroud, the shroud being disposed between the reflector assembly and the housing and enclosing the rear side of the reflector assembly when the reflector assembly is mounted in its use position in the housing, whereby the shroud inhibits heat transfer from the reflector assembly to the housing.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
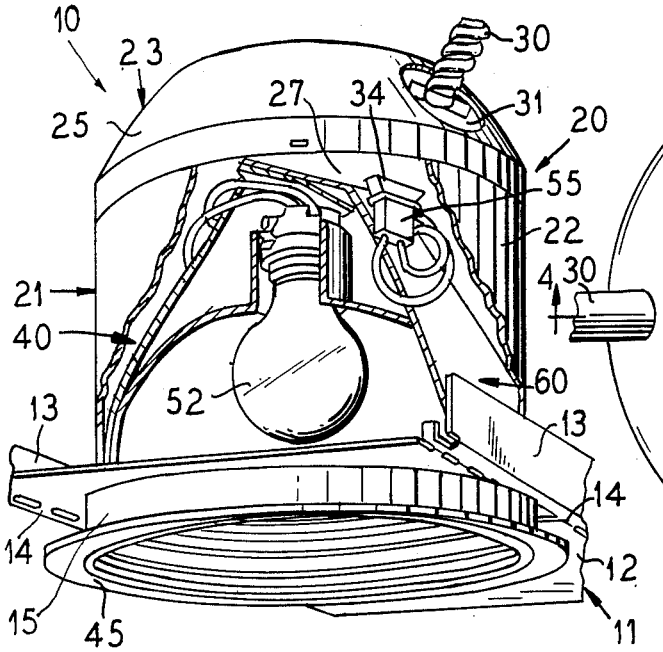
FIG. 1 is a fragmentary perspective view of a recessed lighting fixture constructed in accordance with and embodying the features of a first embodiment of the present invention, with portions broken away more clearly to illustrate the internal construction.
Figure 3:
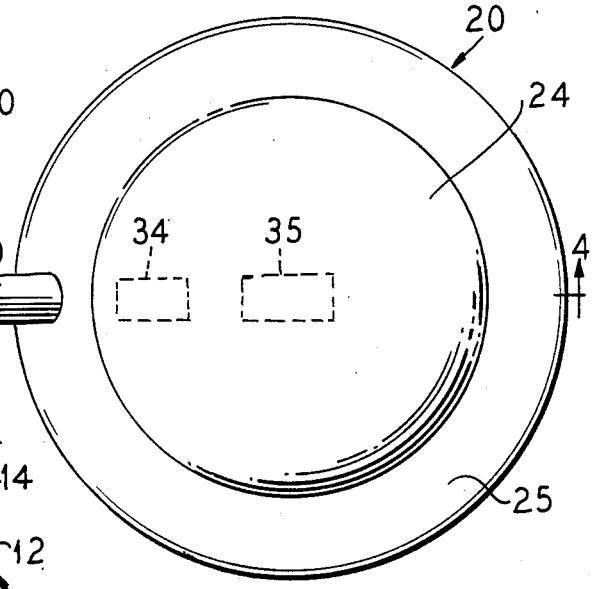
FIG. 3 is a fragmentary top plan view of the lighting fixture of FIG. 1, rotated approximately 180°.

Referring to FIGS. 1–4, there is illustrated a recessed lighting fixture, generally designated by the numeral 10, constructed in accordance with and embodying the features of a first embodiment of the present invention. The lighting fixture 10 includes a plaster frame 11 having a flat, rectangular main plate 12 provided with upstanding side flanges 13 along opposite side edges thereof. Formed in the main plate 12, respectively adjacent and parallel to the side flanges 13, are two separation strips 14, each comprising a plurality of spaced-apart apertures and a score line interconnecting the apertures for cooperation therewith to define a break line to permit the outer side portions of the main plate, including the side flanges 13, to be broken off and separated from the main plate 12. This facilitates installation of the plaster frame 11 in fixture openings in existing ceilings, so that the plaster frame 11 can overly and rest upon the ceiling. Alternatively, particularly in the case of new construction, the plaster frame 11 may be mounted by sliding the side flanges 13 into hanger bar brackets (not shown) before the ceiling is installed, all in a well known manner.

Integral with the main plate 12 and depending therefrom is a short cylindrical plaster ring 15 having a length only slightly greater than the thickness of the associated ceiling, and surrounding a circular opening (not shown) in the main plate 12. Mounted on the main plate 12 adjacent to one end thereof is an electrical junction box 17 for coupling the lighting fixture 10 to the house or building wiring.

The lighting fixture 10 also includes a generally cylindrical housing 20 with a closed top and an open bottom, adapted to be mounted on the main plate 12. More specifically, the housing 20 includes a lower portion 21 comprising a circularly cylindrical wall 22 and an upper portion 23 comprising a circular top wall 24 integral around the perimeter thereof with a depending peripheral wall 25. The bottom edge of the peripheral wall 25 is adapted for overlapping mating engagement with the upper edge of the cylindrical wall 22 by means of couplings 26 (FIG. 4), which may comprise interlocking tabs and recesses. Closing the upper end of the lower portion 21 and secured in place by suitable means is a circular partition plate 27 which cooperates with the upper portion 23 to define an upper chamber 28, and which cooperates with the lower portion 21 to define a lower chamber 29. The lower chamber 29 has its lower end open and disposed for communication with the opening in the main plate 12 of the plaster frame 11.

Figure 4:
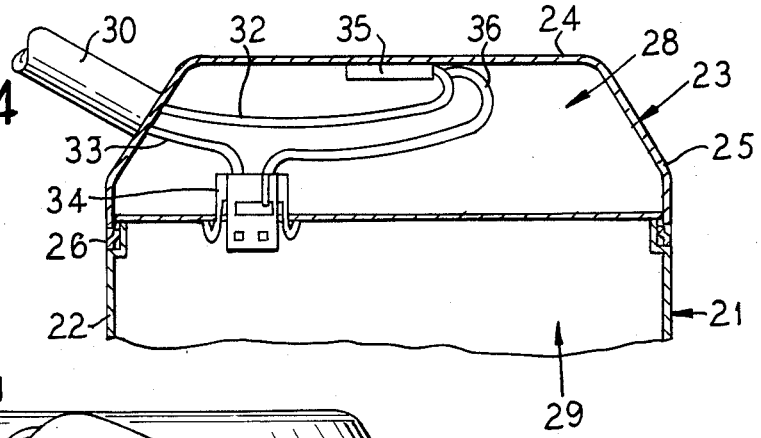
FIG. 4 is a fragmentary view in vertical section taken along the line 4—4 in FIG. 3.
Figure 2:
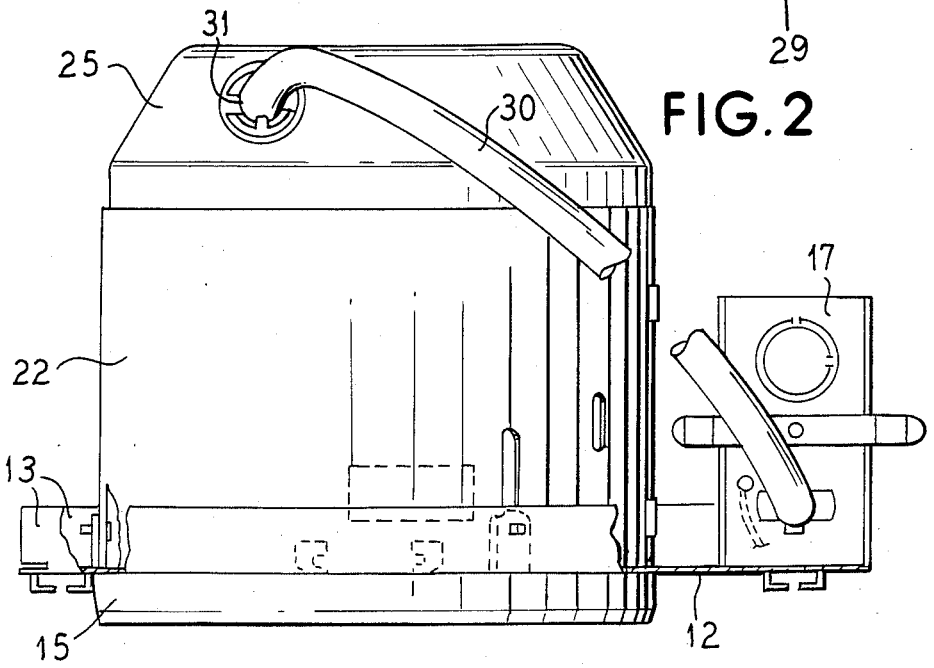
FIG. 2 is a side elevational view of the lighting fixture of FIG. 1, as viewed from the right-hand side thereof, and with portions broken away more clearly to illustrate the construction.

A flexible electrical conduit 30 couples the upper portion 23 of the housing 20 to the junction box 17. More specifically, the conduit 30 is coupled by a fitting 31 through a complementary opening in the peripheral wall 25, the conduit 30 carrying a pair of electrical conductors 32 and 33 (FIG. 4). The conductor 33 is connected to one terminal of a female receptacle 34 which is mounted in a complementary opening in the partition plate 27. The other conductor 32 is connected to one terminal of a temperature-responsive switch 35 mounted on the top wall 24, the other terminal of the switch 35 being coupled by a conductor 36 to the other terminal of the receptacle 34. While the switch 35 is preferably disposed in the upper chamber 28, it will be appreciated that it could be disposed elsewhere in the lighting fixture 10. Mounted on the inner surface of the cylindrical wall 22 adjacent to the lower end thereof are two spaced-apart mounting brackets 37 (see FIG. 6), for use in mounting a reflector assembly 40 in the housing 20.

Figure 5:
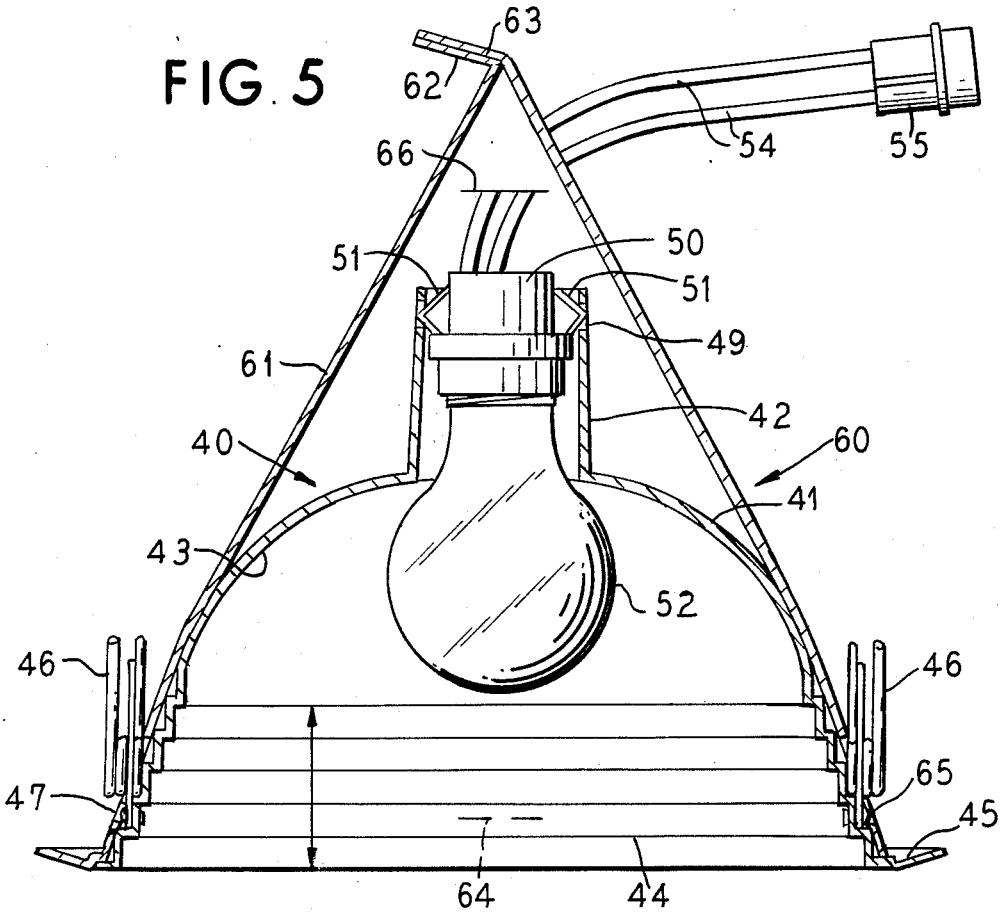
FIG. 5 is an enlarged fragmentary view in vertical section of the reflector assembly of the lighting fixture of FIG. 1.
Figure 6:
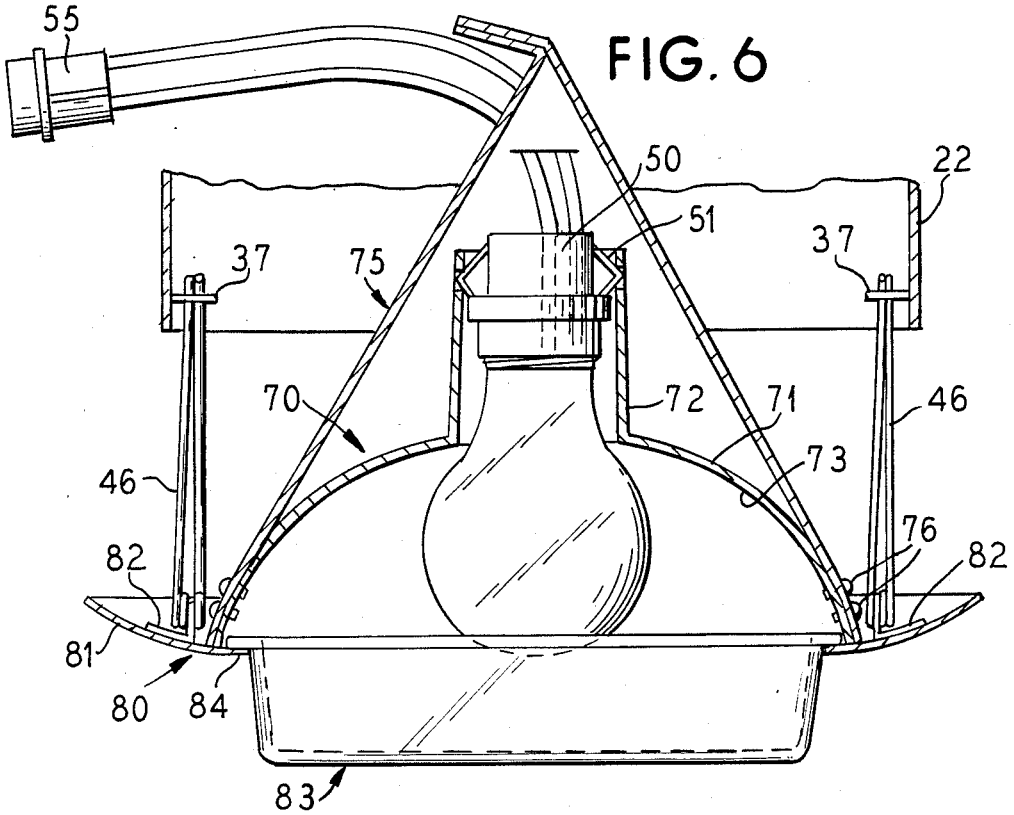
FIG. 6 is a fragmentary view similar to FIG. 5, illustrating an alternative reflector assembly and illustrating the manner of mounting thereof in the fixture housing.

Referring now also to FIGS. 5 and 6 of the drawings, the reflector assembly 40 includes a generally bowl-shaped reflector shell 41 having the apex thereof communicating with a cylindrical neck 42. The reflector shell 41 has a concave front reflective side 43 which is disposed downwardly in use, the reflector shell 41 being integral along its lower edge with a stepped, glare-reducing baffle flange 44. Integral with the baffle flange 44 at the lower end thereof and extending radially outwardly therefrom is an annular trim flange 45. Mounted on the outside of the baffle flange 44 are two diametrically spaced-apart torsion leaf spring sets 46, being secured in place, as by rivets 47. Formed in the neck 42 of the reflector shell 41 are a plurality of spaced-apart apertures 49. A lamp socket 50 is disposed in the neck 42 and is provided with a plurality of mounting clips 51 adapted for resilient engagement in the apertures 49, securely to position the socket 50 in place. The socket 50 is adapted to threadedly receive therein an incandescent lamp 52, in standard fashion. The socket 50 is provided with a pair of electrical conductors 54 which are connected at the distal ends thereof to a male plug 55.

The reflector assembly 40 also includes a thermal shroud 60. The shroud 60 has a generally conical wall 61 and may be formed of a single flexible sheet of thermally insulating and flame-resistant material, such as a glass fiber paper with an aluminum foil laminated on the outer surface thereof, of the type sold by Crane & Co., Inc. under the trademark CRANEGLAS. The sheet forming the conical wall 61 has overlapping edges 62 which are secured together by suitable means such as adhesive, fasteners, or the like, to form a seam 63. The shroud 60 covers the rear side of the reflector shell 41, completely enclosing it, with the lower open end of the conical wall 61 abutting the upper surface of the trim flange 45. The conical wall 61 is fixedly secured to the baffle flange 44 by suitable means, such as a plurality of circumferentially spaced-apart staples 64 (one shown in FIG. 5). Formed in the conical wall 61 adjacent to the lower end thereof are a pair of spaced-apart apertures 65 for respectively receiving therethrough the torsion leaf spring sets 46. Also formed in the conical wall 61 adjacent to the apex thereof is a slit 66 for receiving therethrough the conductors 54 of the socket 50.

In assembling the recessed lighting fixture 10, in the case of new construction, the housing 20 is assembled with the plaster frame 11 coaxially with the plaster ring 15, and the unit is then mounted in place on the associated hanger bar brackets. In the case of existing construction, the housing 20 may first be positioned in the ceiling recess, and then the plaster frame 11 inserted and assembled with the housing 20. Then the conduit 30 is electrically connected to the junction box 17, which is in turn coupled to the house wiring.

When the plaster frame 11 and housing 20 have thus been installed and connected in place, the reflector assembly 40 is mounted in the lower chamber 29 of the housing 20. More particularly, the plug 55 is first plugged into the receptacle 34, and the reflector assembly 40 is then pushed up into the lower chamber 29 to a mounted position illustrated in FIG. 1, wherein the trim flange 45 bears against the lower edge of the plaster ring 15. The leaves of the torsion leaf spring sets 46 are folded up together and inserted into the mounting brackets 37 (see FIG. 6), so that when the reflector assembly 40 is disposed in its use position, the leaf spring sets 46 cooperate with the mounting brackets 37 frictionally to hold the reflector assembly 40 in place. In this use position, it can be seen that the lamp 52 cooperates with the reflective side 43 of the reflector shell 41 for directing a beam of light downwardly through the opening of the plaster frame 11 in a known manner.

In operation, it will be seen that the upper portion of the thermal shroud 60 is spaced from the reflector shell 41 and the neck 42 thereof for providing an air space which can serve as a heat sink. Most of that portion of the heat from the lamp 52 which is radiated upwardly is trapped in this space, the thermal shroud 60 serving to inhibit further upward heat transfer into the lower chamber 29 or the walls of the housing 20. Additionally, it will be noted that the thermal shroud 60 is spaced from the cylindrical wall 22 of the housing 20, except at the lower ends thereof below the lamp 52. Thus, thee is provided another heat sink space in the lower chamber 29 between the thermal shroud 60 and the walls of the lower chamber 29. This will tend to sufficiently reduce the amount of heat transmitted to the cylindrical wall 22, so that insulation can be installed around the housing 20 without danger of fire.

Finally, the partition plate 27 further serves to inhibit the transfer of heat to the upper chamber 28. Thus, the temperature in the upper chamber 28 will be sufficiently low so as to create no chance of danger to the electrical conductors 32, 33, and 36 or any other electrical circuitry which may be disposed therein. Additionally, the temperature of the upper portion 23 of the housing 20 will be sufficiently low that insulation can be disposed in contact therewith.

The temperature-responsive switch 35 is connected in series with the lamp 52. The switch 35 is normally closed and is set to open when the temperature in the upper chamber 28 reaches a predetermined temperature high enough to create a risk of damage either to the electrical wiring and components in the upper chamber 28 or to the surrounding insulation. Thus, when the switch 35 opens it disconnects the lamp 52 to prevent further buildup of heat in the lighting fixture 10.

Because of the thermal insulation provided by the thermal shroud 60 and by the dual compartment construction of the housing 20, higher wattage lamps can be used in the lighting fixture 10 than was previously the case. For example, in many indoor installations, the local building codes have been such as to limit prior recessed lighting fixtures to use with incandescent lamps of no greater than 40 watts output. In such applications the recessed lighting fixture 10 of the present invention can be used with lamps of 60 or 75 watts without risk of overheating.

In a working model of the recessed lighting fixture 10, the plaster frame 11 is formed of painted or or enameled sheet steel, the reflector shell 41 is formed of anodized aluminum, the trim flange 45 is formed of painted or plated steel, and the socket 50 is formed of porcelain. However, it will be appreciated that other alternative materials could be used for these parts.

Referring now to FIG. 6, there is illustrated an alternative form of reflector assembly, generally designated by the numeral 70, adapted to be mounted in the housing 20. The reflector assembly 70 is similar to the reflector assembly 40, including a reflector shell 71 having a cylindrical neck 72 and a concave reflective front side 73. The reflector shell 71 is similar to the reflector shell 41, except that the baffle flange 44 is omitted. The reflector assembly 70 includes a socket 50 in the same manner as described above in connection with FIG. 5. A thermal shroud 75 encloses the rear side of the reflector shell 71 and the socket 50, the thermal shroud 75 being substantially the same as the thermal shroud 60 except for size. The lower open end of the thermal shroud 75 is fixedly secured to the reflector shell 71 by suitable means, such as rivets 76.

Mounted on the reflector assembly 70 is a trim assembly 80 which includes an annular trim ring 81 carrying on the upper surface thereof a pair of mounting brackets 82, to which are respectively mounted the torsion leaf spring sets 46. A generally cup-shaped lens globe 83, which may be formed of glass or other suitable transparent or translucent material, is carried by the trim ring 81, the globe 83 being provided with an annular and radially outwardly extending mounting flange 84 which rests upon the inner edge of the trim ring 81.

The reflector assembly 70 is mounted in the housing 20 in the same manner as was described above with respect to the reflector assembly 40, until the reflector assembly 40 is disposed in a use position with the trim ring 81 bearing against the lower edge of the cylindrical wall 22 of the housing 20.

Figure 7:
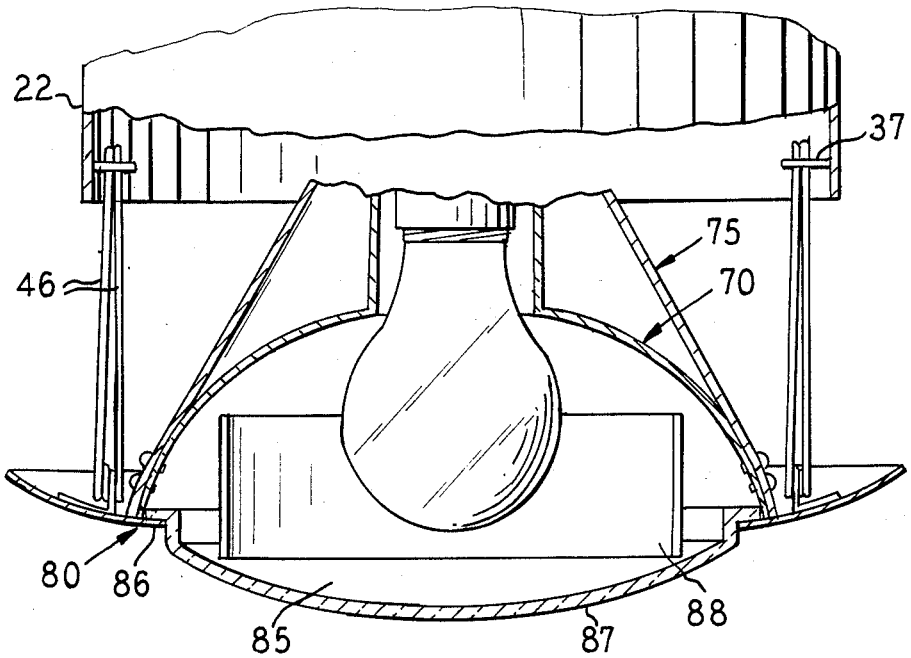
FIG. 7 is a view similar to FIG. 6 of still another embodiment of reflector assembly in accordance with the present invention.
Figure 8:
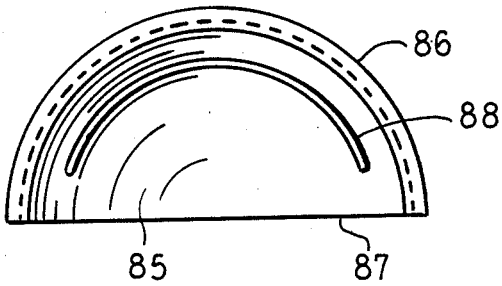
FIG. 8 is a reduced top plan view of the lens globe of the reflector assembly of FIG. 7.

Referring to FIGS. 7 and 8, there is illustrated an alternative form of lens globe 85 for use with the trim assembly 80. The lens globe 85 is generally semicircular in shape and has a slightly convex outer surface. The lens globe 85 is provided with a semiannular mounting flange 86 for supporting it on the trim ring 81. The lens globe 85 has a straight diametrical side edge 87. Integral with the upper surface of the lens globe 85 and projecting upwardly therefrom is a semicylindrical baffle 88. The lens globe 85 may be formed of an opaque material and the concave surface of the baffle 88 may be reflective, so that the lens globe 85 operates to direct light out beyond the edge 87 of the globe 85 in one direction. This type of trim assembly 80 is useful for "wall-wash" applications and the like.

From the foregoing, it can be seen that there has been provided an improved recessed lighting fixture which is thermally protected so as to inhibit and minimize heat buildup, the fixture being particularly designed so as to minimize heat transfer from the reflector assembly into the associated housing, and to further minimize heat transfer to the upper portion of the housing. There results a fixture which can be used with higher wattage lamps, can be installed in close proximity to surrounding insulation and which can carry electrical circuitry in the upper portion thereof without danger of thermal damage thereto.

What is claimed:

1. A recessed lighting fixture comprising a housing, partition means disposed in said housing for dividing it into upper and lower portions, said partition means cooperating with said upper portion of said housing for defining a closed upper chamber, said partition means cooperating with said lower portion of said housing for defining a lower chamber having an open bottom, a reflector assembly having a rear side a reflective front side and adapted for receiving an associated lamp, said reflector assembly being mountable in said lower chamber in a use position with said rear side facing the inside of said housing and with said reflective front side disposed for cooperation with the lamp to direct a beam of light through the open bottom f said lower chamber, and a thermally insulating shroud, said shroud being disposed between said reflector assembly and said lower portion of said housing and enclosing said rear side of said reflector assembly when said reflector assembly is mounted in its use position in said lower chamber, said reflector assembly and said shroud being dimensioned and arranged to only partially fill said lower chamber, said shroud being carried by said reflector assembly for mounting and demounting therewith in said lower chamber whereby said shroud inhibits heat transfer from said reflector assembly to said lower chamber and said lower portion of said housing; and whereby the unfilled space of said lower chamber cooperates with said partition means for inhibiting heat transfer to said upper chamber and to said upper portion of said housing.

2. The lighting fixture of claim 1, and further including circuit means disposed in said upper chamber and adapted for connection to an associated source of electrical power.

3. The lighting fixture of claim 2, wherein said circuit means includes a female receptacle mounted on said partition means, said reflector assembly including a lamp socket, and plug means electrically connected to said lamp socket and adapted to be plugged into said receptacle for connecting said reflector assembly to said circuit means.

4. The lighting fixture of claim 3, wherein said reflector assembly includes electrical conductors interconnecting said lamp socket and said plug, said shroud being formed of glass fiber paper and having a slit opening therein for receiving said conductors therethrough.

5. A recessed lighting fixture comprising a housing, partition means disposed in said housing for dividing it into upper and lower portions, said lower portion of said housing being substantially circularly cylindrical in shape, said upper portion of said housing being substantially cup-shaped, said partition means comprising a circular plate coaxial with said lower portion of said housing, said partition means cooperating with said upper portion of said housing for defining a closed upper chamber, said partition means cooperating with said lower portion of said housing for defining a lower chamber having an open bottom, and a reflector assembly mountable in said lower chamber and adapted to receive an associated lamp for cooperation therewith to direct a beam of light through the open bottom of said lower chamber, circuit means disposed in said upper chamber adapted for coupling said reflector assembly to an associated source of electrical power, said circuit means including a female receptacle mounted on said partition means, said reflector assembly including a lamp socket, and plug means electrically connected to said lamp socket and adapted to be plugged into said receptacle for connecting said reflector assembly to said circuit means, said reflector assembly being dimensioned and arranged to only partially fill said lower chamber so that the unfilled space of said lower chamber cooperates with said partition means for inhibiting heat transfer to said upper chamber and to said upper portion of said housing.

6. The lighting fixture of claim 5, wherein said circuit means includes temperature-responsive switch means for disconnecting said reflector assembly from the associated source of electrical power when the temperature in said upper chamber exceeds a predetermined temperature.

7. The lighting fixture of claim 5, wherein said upper and lower portions of said housing are respectively formed as separate members attachable to each other.

8. In a recessed lighting fixture including a housing having an open bottom and a closed top, and a reflector assembly having a rear side and a reflective front side and adapted for receiving an associated lamp, wherein the reflector assembly is mountable in the housing in a use position with the rear side facing the inside of the housing and with the reflective front side disposed for cooperation with the lamp to direct a beam of light through the open bottom of the housing, the improvements comprising: a thermally insulating shroud, said shroud being disposed between said reflector assembly and the housing and enclosing the rear side of said reflector assembly when said reflector assembly is mounted in its use position in the housing, said shroud being carried by the reflector assembly for mounting and demounting therewith in the housing whereby said shroud inhibits heat transfer from said reflector assembly to the housing.

9. The lighting fixture of claim 8, wherein the reflector assembly includes a lamp socket and electrical conductors therefor, said shroud having a slit opening therein for receiving said electrical conductors therethrough.

10. The lighting fixture of claim 8, and further including circuit means for connecting the reflector assembly to an associated source of electrical power, said circuit means including temperature-responsive switch means for disconnecting the reflector assembly from the associated source of electrical power when the temperature in the housing exceeds a predetermined temperature.

11. In a recessed lighting fixture including a housing having an open bottom and a closed top, and a reflector assembly having a rear side and a reflective front side and adapted for receiving an associated lamp, wherein the reflector assembly is mountable in the housing in a use position with the rear side facing the inside of the housing and with the reflective front side disposed for cooperation with the lamp to direct a beam of light through the open bottom of the housing, the improvements comprising: a thermally insulating shroud generally conical in shape, said shroud being disposed between said reflector assembly and the housing and enclosing the rear side of said reflector assembly when said reflector assembly is mounted in its use position in the housing, whereby said shroud inhibits heat transfer from said reflector assembly to the housing.

12. The lighting fixture of claim 11, wherein said shroud is formed of a flame-resistant material.

13. The lighting fixture of claim 12, wherein said shroud is formed of glass fiber paper.

14. A recessed lighting fixture comprising a housing, partition means disposed in said housing for dividing it into upper and lower portions, said partition means cooperating with said upper portion of said housing for defining a closed upper chamber, said partition means cooperating with said lower portion of said housing for defining a lower chamber having an open bottom, a reflector assembly having a rear side a reflective front side and adapted for receiving an associated lamp, said reflector assembly being mountable in said lower chamber in a use position with said rear side facing the inside of said housing and with said reflective front side disposed for cooperation with the lamp to direct a beam of light through the open bottom of said lower chamber, and a thermally insulating shroud, generally conical in shape, said shroud being disposed between said reflector assembly and said lower portion of said housing and enclosing said rear side of said reflector assembly when said reflector assembly is mounted in its use position in said lower chamber, said reflector assembly and said shroud being dimensioned and arranged to only partially fill said lower chamber, whereby said shroud inhibits heat transfer from said reflector assembly to said lower chamber and said lower portion of said housing, and whereby the unfilled space of said lower chamber cooperates with said partition means for inhibiting heat transfer to said upper chamber and to said upper portion of said housing.

15. A recessed lighting fixture for receiving an incandescent lamp having a filament comprising:

a housing having an open bottom positioned at least level with or below said lamp filament and a closed top, a reflector assembly having a rear side and a reflective front side with an open bottom end positioned at least level with or below said lamp filament, said reflector assembly mountable in said housing in a use position with the rear side facing an inside of said housing and with the reflective front side disposed for cooperation with the lamp to direct a beam of light through the open bottom of the housing, a thermally insulating shroud disposed between said reflector assembly and the housing having an open bottom end positioned at least level with or below said lamp filament, and a closed top end enclosing the rear side of said reflector assembly when said assembly is in its use position in the housing, whereby, said shroud inhibits heat transfer from said reflector assembly to the housing.

16. In a recessed lighting fixture including a housing having an open bottom and a closed top, and a reflector assembly having a rear side and a reflective front side and adapted for receiving an associated lamp, wherein the reflector assembly is mountable in the housing in a use position with the rear side facing the inside of the housing and with the reflective front side disposed for cooperation with the lamp to direct a beam of light through the open bottom of the housing, the improvements comprising: a thermally insulating shroud comprising an aluminum foil backed glass fiber paper, said shroud being disposed between said reflector assembly and the housing and enclosing the rear side of said reflector assembly when said reflector assembly is mounted in its use position in the housing.

17. A recessed lighting fixture for receiving an incandescent lamp comprising:

a housing having an open bottom positioned at least level with or below said lamp and a closed top, a reflector assembly having a rear side and a reflective front side with an open bottom end positioned at least level with or below said lamp, said reflector assembly mountable in said housing in a use position with the rear side facing an inside of said housing and with the reflective front side disposed for cooperation with the lamp to dirct a beam of light through the open bottom of the housing, a thermally insulating shroud disposed between said reflector assembly and the housing having an open bottom end positioned at least level with or below said lamp, and a closed top end enclosing the rear side of said reflector assembly when said assembly is in its use position in the housing, whereby, said lamp is horizontally surrounded by three layers comprising said reflector assembly, said shroud and said housing.

* * * * *